US005503265A

United States Patent [19]

Hussar et al.

[11] Patent Number: 5,503,265

[45] Date of Patent: Apr. 2, 1996

[54] WEB DEPOSITING TABLE

[75] Inventors: Walter Hussar, Troisdorf-Bergheim; Josef Nowak, Siegburg, both of Germany

[73] Assignee: Reifenhauser GmbH & Co. Maschinenfabrik, Troisdorf, Germany

[21] Appl. No.: 308,090

[22] Filed: Sep. 16, 1994

[30] Foreign Application Priority Data

Sep. 17, 1993 [DE] Germany ..... 43 31 620.4

[51] Int. Cl.[6] ..... B65G 39/16

[52] U.S. Cl. ..... 198/807; 198/810.03; 198/813

[58] Field of Search ..... 198/810.03, 813, 198/840, 807, 810.04

[56] References Cited

U.S. PATENT DOCUMENTS

| | | | |
|---|---|---|---|
| 2,914,957 | 12/1959 | Johnson | 198/807 |
| 3,513,966 | 5/1970 | Eckels | 198/810.03 |
| 3,545,599 | 12/1970 | Smith et al. | 198/807 |
| 3,963,115 | 6/1976 | Teske et al. | 198/813 |
| 4,860,634 | 8/1989 | Hein | 198/807 |

FOREIGN PATENT DOCUMENTS

| | | | |
|---|---|---|---|
| 204132 | 6/1956 | Australia | 198/807 |
| 834014 | 5/1960 | United Kingdom | 198/807 |

*Primary Examiner*—Joseph E. Valenza
*Attorney, Agent, or Firm*—Herbert Dubno

[57] ABSTRACT

A collecting belt for the web of a spun bond or melt blown apparatus has one deflecting roller with fixed bearings and another deflecting roller with floating bearings upon which pneumatic cylinders act to provide equal forces. Upon the pneumatic system a proportional controller in response to the belt position sensor superimposes control signals to compensate for deviations in belt orientation.

6 Claims, 2 Drawing Sheets

WEB DEPOSITING TABLE

FIELD OF THE INVENTION

Our present invention relates to a web depositing table for a web composed of thermoplastic synthetic resin filaments and, more particularly, to a table formed by a sieve belt for the continuous production of a nonwoven web of thermoplastic synthetic resin filaments by the spun bond or melt blown processes.

BACKGROUND OF THE INVENTION

It is known to produce continuously a fleece-like web or mat of thermoplastic synthetic resin filaments by processes which generate continuous filaments, such as the spun bond process described, for example, in German application DE-OS 40 14 413 or from segments of the filamentary product by, for example, the melt blown process described in German Patent DE-PS 40 36 734.

In either case, above a generally horizontal stretch of the sieve belt, forming the receiving table, a source of the filamentary product deposits the filaments continuously on the belt where the web is collected.

The sieve belt itself is generally composed of a woven or knitted wire fabric or wire netting of steel wire, bronze wire or the like. In practice the belt has an elasticity and thus an elongation under the applied tension which is not negligible.

It is important in the long term production of continuous webs as described to maintain a setpoint orientation of the sieve belt with low tolerances so that the orientation is not altered on standstill and start up of the belt and which is maintained with minimum deviations over the duration of web production.

In practice this has been achieved in the past only with highly specialized control devices or controlled rollers or the like over which the endless sieve belt is guided, in addition to the deflecting rollers normally provided at ends of the path of the belt. These earlier control systems have been found to be expensive to set up and maintain, and frequently cannot compensate for temperature gradients across the length and width of the belts and their variations in thermal expansion and contraction and which may detrimentally influence the belt path. When fluctuations in belt path occur, the quality of the product, namely, the homogeneity or consistency of the density distribution in the web can be detrimentally affected.

In other fields in which endless belts of a variety of materials are used and are guided around deflecting rollers at ends of the path, there have been proposals to limit deviations from a desired belt path.

The prevailing thought in these systems is that the longitudinal tension varies across the width thereof In accordance with these teachings, the band has a tendency to move toward the side with the smaller longitudinal tension (cf German published Application DE-AS 26 43 346, col. 2, lines 9–22). With sieve belts and receiving tables for webs of the type described, the prevailing teachings in other fields have not had any significant influence.

OBJECTS OF THE INVENTION

It is the principal object of the present invention to provide an improved sieve belt receiving table for the continuous production of a nonwoven filamentary web of the synthetic resin in accordance with the spun bond or melt blown process, whereby detrimental belt travel and adverse affects of varying belt travel upon the web can be reliably avoided or reduced.

Another object of the invention is to provide an improved receiving belt for such web whereby drawbacks of prior art systems are obviated.

SUMMARY OF THE INVENTION

These objects and others which will become apparent hereinafter are attained in accordance with the invention in a receiving or collecting table for a web of the type described which comprises under the spun bond or melt blowing fiber or filament generator, an openwork belt, i.e. a sieve belt, which passes over front and rear deflecting rollers in an endless path, the deflecting rollers being substantially parallel to one another and at least one of which is driven. The belt, from an orientation point of view has a setpoint position.

According to the invention, one of the deflecting rollers is journaled with its axis or shaft in fixed bearings. The other deflecting roller is journaled with its axis or shaft in bearings which are connected respectively to fluid pressure actuators operating orthogonally to the axis of this other deflecting roller. The two fluid pressure actuators or drivers are preferably pneumatic or operate with pneumatic cushions and the two actuators or drivers act upon the movable bearings of the axis or shaft of the second roller with equal forces depending upon the predetermined sieve belt tension required. The band path, according to the invention is monitored by a band path sensor and upon deviation of the belt path from the setpoint path, the sensor effects control which is superimposed upon the fluid pressure actuator system in dependence upon deviation from the setpoint. Furthermore, an emergency switching system is provided which brings the sieve belt to standstill as may be necessary, terminating the control which is superimposed upon the pressurizable actuators and restoring the equal force provided by the actuators to the shaft or axis as a function of the predetermined belt tension.

More particularly, in an apparatus for producing a continuous web or spun bond or melt blown thermoplastic filaments, the sieve belt web depositing table comprises:

- at least two spaced-apart rollers having substantially parallel and generally horizontal axes and defining a travel path, including a relatively forwardly roller and a relatively rearwardly roller;
- an endless sieve belt extending around and engaging the rollers and traveling along the path, the belt having a generally horizontal stretch below a source of the filaments for collecting the web;
- a drive operatively connected to one of the rollers for driving the belt;
- a pair of fixed bearings rotatably supporting a first of the rollers;
- a pair of individually movable bearings rotatably supporting a second of the rollers;
- a respective fluid-pressurizable actuator operatively connected to each of the movable bearings for displacing same with at least a component of movement in a direction orthogonal to the axis of the second roller;
- pressure-regulating means operatively connected with the actuators for applying identical forces to the bearings selected to maintain a predetermined tension of the belt;
- a sensor juxtaposed with the belt for detecting deviations in orientation of the belt during travel of the belt from a set-point orientation of the path;

a controller connected to the sensor and responsive to the deviations, the controller being connected to the pressure-regulating means for superimposing control of the forces thereon in dependence upon magnitudes of the deviations for correcting the deviations and restoring orientation of the belt to the setpoint orientation of the path; and an emergency shut-off connected to terminate drive of the belt and interrupt the control of the forces by the controller to bring the belt to standstill with application by the actuators of the identical forces to the bearings to maintain the predetermined tension of the belt.

The invention is based upon the concept that a sieve belt of a woven, knitted or net fabric of steel wire, bronze wire or the like has a certain elasticity and thus elongation under the tension necessary to support the web.

Especially when there are different temperature gradients across the length and width of such a belt, varying thermal characteristics arise. By normally applying constant force with the pneumatic piston-and-cylinder actuators and then controlling the individual pressures in response to the sensor which monitors incipient changes from belt position, all of the tendencies toward deviation from the setpoint belt path can be immediately corrected. The correction is achieved with the floating bearings of one off the deflecting rollers directly.

Even in the case of emergency shut down there is no problem since the control superimposed upon the pneumatic system is then lifted and the two floating bearings receive identical forces depending upon the belt tension which is desired so that startup can once again set in operation the correct mode without any danger that previous control setting will itself create problems.

Especially good results can be achieved with the apparatus of the invention when the yieldability or elongation of the belt is limited to about 1% of its length under the operating conditions which are provided in accordance with the invention.

Preferably the pneumatic cylinders are operated with a pressure of 2 to 5 bar, most advantageously about 3 bar. This has been found to give a high flexibility of control, especially within the elastic characteristics of the belt and with surprisingly effective and reliable maintenance of the web product which results. Preferably control is effected with compressed air.

It has been found to be particularly advantageous to utilize proportional controller between the pneumatic system and the sensor (see Chapter 22, page 77 ff of Chemical Engineer's Handbook, 5th Edition, McGraw Hill Book Company, N.Y. 1973).

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
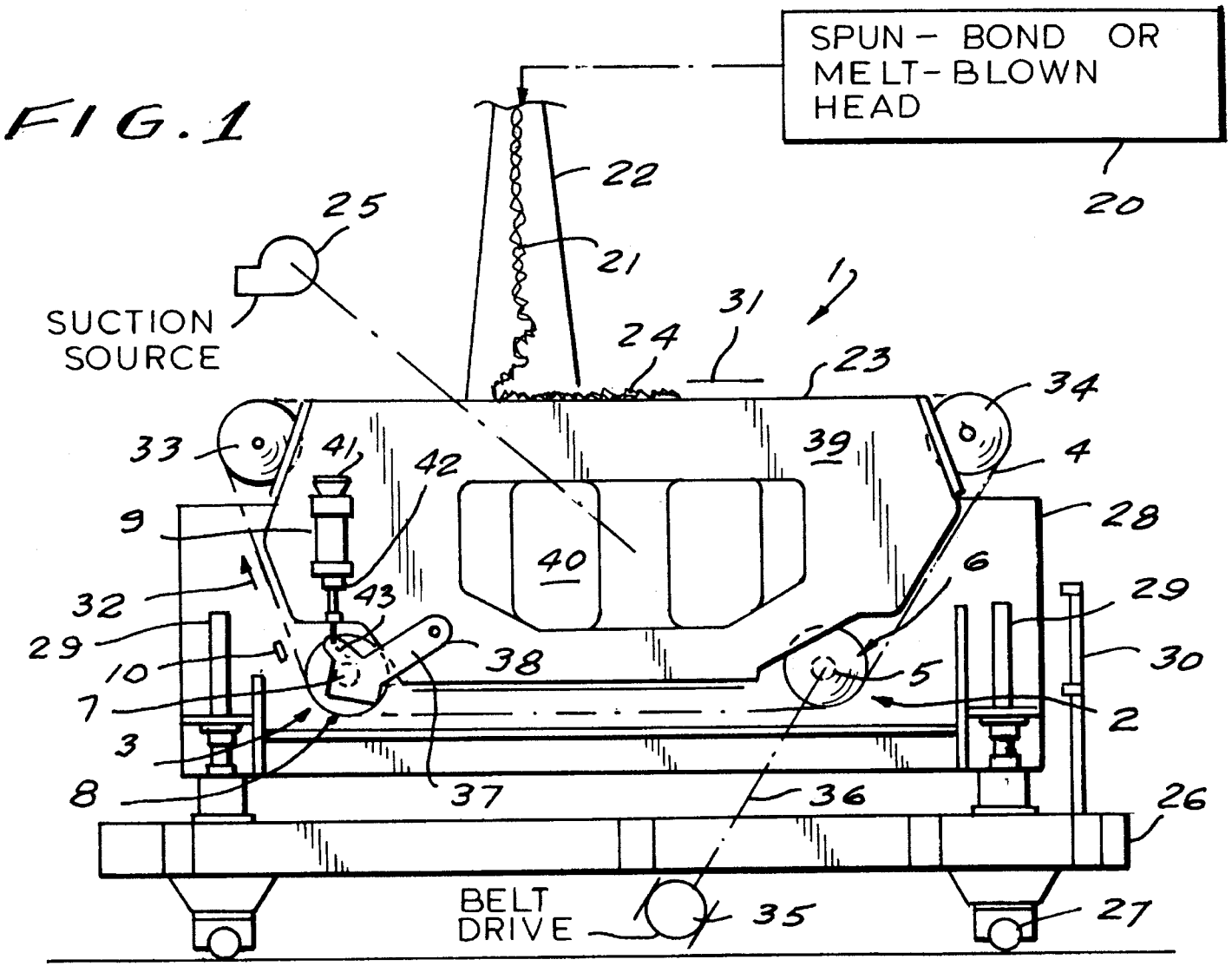
FIG. 1 is a side elevational view in highly diagrammatic form of a sieve belt collecting table receiving a filamentary web.

In the drawing we have shown a sieve belt collecting or receiving table 1 forming part of a spun bond or melt blown apparatus in which the spun bond or melt blown head produces a curtain of filaments, either in the form of continuous filaments in the case of a spun bond apparatus where a stream of filament segments in the case of a melt blown apparatus, the curtain of filaments 21 passing through a guide duct 22 onto the horizontal receiving surface 23 of the table 1 forming the filamentary web or fleece 24 in a continuous manner. Since the receiving surface 23 of the open work belt (i.e. a wire fabric of woven, knitted or net type), is permeable, the region below the belt can be evacuated by a suction source 25 represented diagrammatically in FIG. 1. For convenience in positioning, maintenance and handling, the receiving table 1 may be provided with a carriage 26 riding on wheels 27, having support plates 28 straddling the belt and vertically adjustable on spindles or posts 29. A handle 30 allows the carriage to be pushed or pulled into or out of position.

Basically the receiving table comprises a front deflecting roller 2 and a rearward deflecting roller 3 about which the sieve belt can pass. The terms forward and rearward are used to indicate direction relative to the web feed direction 31, the belt 4 passing in the section of arrow 32. The roller 3 is forwardly of the roller 2 in the sense of belt travel and the belt 4 can pass over other rollers 33 and 34 which, like the roller 2, can have fixed bearings, e.g. bearings which are fixed on the plates 28. A drive for the belt is represented by the motor 35 which is connected at 36 to one of the deflecting rollers, e.g. the deflecting roller 2 with the fixed bearings.

The belt 4 has a setpoint path from which tendencies to deviation occur which are unavoidable and are systematic or stoicastic but which, in accordance with the invention can be controlled to practically zero.

As noted, one of the deflecting rollers (2) has its axle or shaft 5 received in fixed bearings 6. The other deflecting roller 3 has its axle or shaft 7 journaled in bearings 8 which are movable. In the embodiment shown in FIG. 1, each of the bearings 8 is received in an arm 37 pivotally mounted at 38 on a frame member 39 connected to the plates 28 and defining the evacuated plenum 40 beneath the receiving surface 23.

Each of the movable or floating bearings 8 has a respective fluid pressure actuator 9 connected therewith. In the embodiment illustrated each actuator 9 is a pneumatic cylinder pivotally connected at 41 to the respective side of the frame 39 and having piston rod 42 pivotally connected at 43 to a lug of the lever 37 of the respective floating bearing.

Of course, both the front and rear rollers 2 and 3 may have their shafts received in floating bearings 8 with respective pneumatic actuators 9 connected thereto.

The actuators 9 apply to the bearings 8 equal forces on both sides of the respective roller 3, the forces serving to produce the predetermined belt tension. The result is a floating bearing under pneumatic pressure without blocking of the pneumatic actuators.

The belt path is monitored by at least one sensor 10 which preferably is juxtaposed with the belt, e.g. at an end thereof in the region of the deflecting roller 3. Deviations of the belt path are detected by the sensor 10, e.g. in the form of a shift of the edge of the belt to one side or the other and via a proportional controller (FIG. 2) 50 a control is superimposed upon the actuators 9 in proportion to the deviation to correct the position of the belt and restore it to the setpoint position.

An emergency shutoff 51 is provided which ensures that subsequent to a shutdown the apparatus can be brought to standstill and restarted without problems. With emergency shutoff the belt 4 is brought to standstill by deenergizing the belt drive 35. The superimposed control action is terminated and the two pneumatic actuators 9 again apply to the floating bearings 8 equal force at opposite ends of the roller 3 at the magnitude required for the predetermined belt tension. The pneumatic actuators 9 are operated at a pressure of 2 to 5 bar, preferably bout 3 bar.

Figure 2:
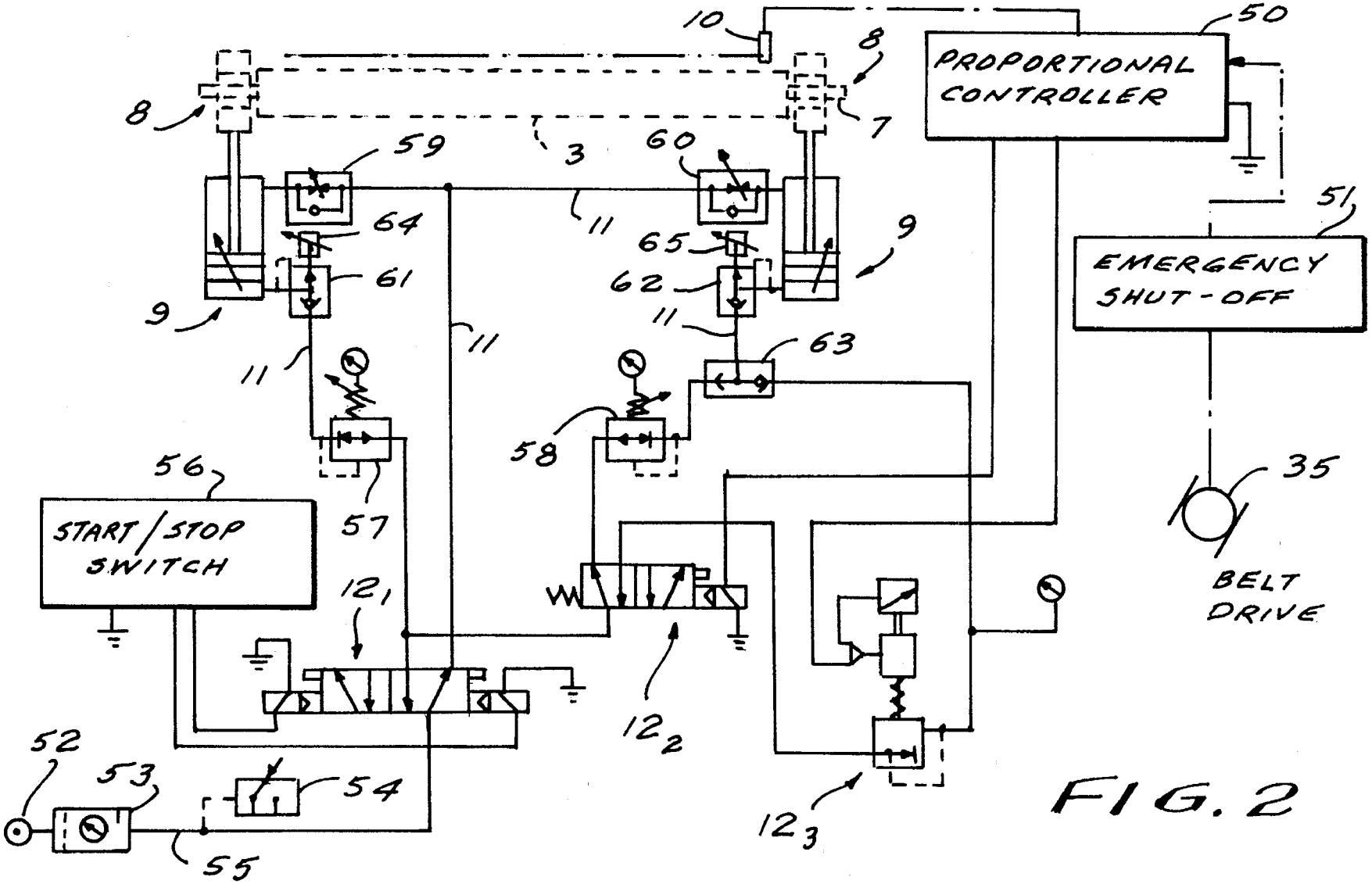
FIG. 2 is diagram of a control system for that table in accordance with the invention.

It can be seen from FIG. 2, the actuators 9 are connected to a compressed air source 52 having a filter and gauge 53 and a constant-pressure valve 54 in the line 55. The apparatus has controlled valves $12_1$,$12_2$ and $12_3$ which may be connected to the proportional controller 50 and a start/stop switch 56, a number of pressure relief valves 57 and 58 which blow of excess pressure, throttles 59 and 60 which regulate rate of movement of the pistons of the actuators 9 and double acting valves 61, 62 and 63 which function as check valves in one direction and in the other direction permit flow. Controlled constant pressure valves 64 and 65 can be provided to prevent actuation of the cylinders with excessive pressure.

The actuator 9 are thus operated with a pneumatic system which comprises the lines 11 in addition to the pneumatic circuit elements described. Upon switching on-off the table 1 in conjunction with the generation of the filaments or fibers to be collected in the web, the magnetic valve 12 is switched on to provide equal pressures to the two pneumatic cylinders 9. Since the two cylinders 9 are identical, the identical forces are applied to the opposite ends of the shaft 7 of the roller 3. When the sensor 10 detects aa deviation, the controller 50 operates the valves $12_2$, $12_3$ in proportional control to superimpose on the actuators 9 the fluid control to restore the belt to its setpoint position.

We claim:

1. In an apparatus for producing a continuous web of spun-bond or melt-blown thermoplastic filaments, a sieve-belt web-depositing table which comprises:

at least two spaced-apart rollers having substantially parallel and generally horizontal axes and defining a travel path, including a relatively forwardly roller and a relatively rearwardly roller;

an endless sieve belt extending around and engaging said rollers and traveling along said path, said belt having a generally horizontal stretch below a source of said filaments for collecting said web;

a drive operatively connected to one of said rollers for driving said belt;

a pair of fixed bearings rotatably supporting a first of said rollers;

a pair of individually movable bearings rotatably supporting a second of said rollers;

a respective fluid-pressurizable actuator operatively connected to each of said movable bearings for displacing same with at least a component of movement in a direction orthogonal to the axis of said second roller;

pressure-regulating means operatively connected with said actuators for applying identical forces to said bearings selected to maintain a predetermined tension of said belt;

a sensor juxtaposed with said belt for detecting deviations in orientation of said belt during travel of said belt from a set-point orientation of the path;

a controller connected to said sensor and responsive to said deviations, said controller being connected to said pressure-regulating means for superimposing control of said forces thereon in dependence upon magnitudes of said deviations for correcting said deviations and restoring orientation of said belt to said set-point orientation of said path; and an emergency shut-off connected to terminate drive of said belt and interrupt said control of said forces by said controller to bring said belt to standstill with application by said actuators of said identical forces to said bearings to maintain said predetermined tension of said belt.

2. The apparatus defined in claim 1 wherein said belt has and elongation of about 1%.

3. The apparatus defined in claim 1 wherein said actuators are pneumatic piston-and-cylinder units.

4. The apparatus defined in claim 3 wherein said piston-and-cylinder units are pressurized with compressed air at a pressure of 2 to 5 bar.

5. The apparatus defined in claim 4 wherein said piston-and-cylinder units are pressurized with compressed air at a pressure of about 3 bar.

6. The apparatus defined in claim 1 wherein said controller is a proportional controller.

* * * * *